United States Patent [19]

Matsumoto et al.

[11] 4,299,109

[45] Nov. 10, 1981

[54] ROLLING MILL WITH LOOSELY SLEEVED ROLL

[75] Inventors: Hiromi Matsumoto, Kitakyushu; Toshio Kikuma, Fukuoka; Koe Nakajima, Nakama; Akira Ohnuki, Kutakyushu, all of Japan

[73] Assignee: Nippon Steel Corporation, Tokyo, Japan

[21] Appl. No.: 128,924

[22] Filed: Mar. 10, 1980

Related U.S. Application Data

[63] Continuation of Ser. No. 12,195, Feb. 14, 1979, abandoned.

[30] Foreign Application Priority Data

Feb. 18, 1978 [JP] Japan ..... 53-17961

[51] Int. Cl.[3] ..... B21B 13/00; B21B 27/00

[52] U.S. Cl. ..... 72/241; 72/247

[58] Field of Search ..... 72/241–243, 72/199, 366, 247; 29/116 AD

[56] References Cited

U.S. PATENT DOCUMENTS 4,059,976 11/1977 Crist et al. ..... 72/241 X

FOREIGN PATENT DOCUMENTS 46-11247 3/1971 Japan ..... 72/241

6223022 4/1968 U.S.S.R. ..... 72/199

*Primary Examiner*—Milton S. Mehr

*Attorney, Agent, or Firm*—Wenderoth, Lind & Ponack

[57] ABSTRACT

A rolling mill includes at least one roll carrying a sleeve loosely on the barrel, and a sleeve-supporting-and-guiding unit the restricting point of which, i.e. the point at which force for axially shifting or restricting the shifting of the sleeve is applied on the sleeve, is located somewhere along the second-half semi-circular portion of the sleeve as viewed in the rotational direction of a complete turn of the sleeve ending at the loading point where the sleeve and the associated roll are subjected to loading pressure. The mill has a powerful crown-controlling capacity for workpieces varying widths, and the sleeve-supporting-and-guiding unit is sufficiently durable to withstand high speed rolling for mass production.

7 Claims, 13 Drawing Figures

ROLLING MILL WITH LOOSELY SLEEVED ROLL

This application is a continuation of Ser. No. 012,195, filed Feb. 14, 1979, now abandoned.

DETAILED DESCRIPTION OF THE INVENTION

This invention relates to a rolling mill including one or more than one roll having a sleeve loosely positioned on the roll barrel, and more particularly to such a mill the unit for restraining or restricting the axial shifting of the sleeve during rolling operation of which has greatly extended life and permits high speed rolling.

With conventional multiple rolling mills it has been customary to control the flatness and crown of the product by correcting the deflections of the upper and lower working rolls by the application of roll bending forces between those rolls. However, the practice has failed to achieve completely the desired effect because the control functions are limited by the contact of the working roll shoulders with the surfaces of the back-up rolls. Japanese Laid-Open Patent Publication Nos. 103058/76 and 97353/77 propose methods of controlling the crown of a plate material by positioning sleeves on the back-up rolls of a four high mill, at suitable positions corresponding to the width of the workpiece. According to those inventions, however, the feasibility of shifting the sleeve positions in order to roll workpieces having varied widths has been considered questionable. More recently, attempts to solve this question have been made as disclosed by, Japanese Laid-Open Patent publications Nos. 48051/78 and 48052/78. These inventions propose rolling mills of a construction generally as shown in FIGS. 1(*a*) and (*b*), in which sleeves 4 and 4' are loosely positioned on the outer circumferential surfaces of back-up rolls 3 and 3' and adjustment of sleeve-supporting arms permits the sleeves 4 and 4' to be suitably shifted in the axial directions of the rolls according to the width of the workpiece 1 to be rolled, changing the degree of restriction on the shoulders of the working rolls and thereby controlling the deflections of those rolls. In addition, the effect of the roll bending method is enhanced and the life of the back-up rolls is remarkably extended. Thus, the latter inventions are characterized in that the sleeves 4 and 4' are loosely carried by the back-up rolls 3 and 3' and the arms supporting the sleeves 4 and 4' are shifted in the axial directions of the rolls by screw or fluid-pressure cylinder means.

As compared with the former two inventions, the latter two prior items are distinguished by a construction in which each sleeve 4 is loosely positioned on the associated roll 3 with a free space provided between them, so that the sleeve 4 can be shifted axially with respect to the roll according to the width of the workpiece 1 to be handled. Nevertheless, in high speed rolling operation the mills incorporating these inventions still have the following difficulties. The sleeve-supporting arms, which are subjected to heavy loads, must have great strength. Especially during high speed rolling, contact members, or the means attached to those arms in order to deliver restricting forces to the sleeves by direct contact, rapidly wear down. Moreover, the contact members develop so much heat due to friction that considerable cooling is an unavoidably necessity.

Broadly, the present invention has for its object to overcome the aforedescribed difficulties advantageously and to perfect a rolling mill of the type having loosely sleeved rolls. Specifically, it is within the contemplation of the present invention to provide a rolling mill the sleeve-supporting arms of which are subjected to greatly reduced forces and therefore can be given a simplified construction, and in which there is decreased abrasion of the contact members, so that the mill is capable of high speed rolling.

Thus, in accordance with the invention, there are provided:

(1) A rolling mill including at least one roll on which a sleeve is loosely positioned in such a way that the sleeve is revolvable and axially shiftable with respect to the outer circumferential surface of the barrel of the associated roll, the sleeved roll being subjected to a rolling load, directed to the sleeve center, from one side of the sleeve on the barrel, the outer circumferential surface of the roll barrel being in contact with the inner surface of the sleeve along a narrow area substantially parallel to the roll axis, characterized by the provision of at least one unit for supporting and guiding the sleeve, with a restraining or a restricting point, at which a force of axially shifting or for restraining or restricting spontaneous shifting of the sleeve is applied to the sleeve, lying somewhere along the second-half semicircular portion of the sleeve as viewed in the rotational direction of a complete turn of the sleeve ending at the loading point where the rolling load is received;

(2) a rolling mill according to (1) above in which the units for supporting and guiding the sleeves are installed at both sides of the sleeve as viewed in the rolling direction for alternate use depending on the direction of rotation of the roll;

(3) a rolling mill according to (1) or (2) above, in which each sleeve-supporting-and-guiding unit has contact members, at least one of which is in the form of at least one roller;

(4) a rolling mill according to (1) above, in which the sleeve-supporting-and-guiding unit has contact members, each in the form of a ring having substantially the same diameter as the sleeve;

(5) a rolling mill according to (3) above, in which each of the contact members is in the form of a plurality of rollers;

(6) a rolling mill according to (1) above, in which the sleeve is suported and guided at both axial ends by roller-type contact members secured to blocks in housings at the ends of an arm, and the contact members are moved along the axis of the associated roll by rotating a threaded rod in threaded engagement with the arm, driving power being transmitted to the rod from a motor equipped with a reduction gear through at least one gear box and toothed wheel, and, if necessary, through a connecting rod; and (7) a rolling mill according to (1) above, in which the rolling mill is a four high rolling mill including upper and lower back-up rolls on which sleeves are loosely positioned and each of the sleeves is supported and guided at both ends by a plurality of roller-type contact members secured to blocks in housings at the both ends of an arm, the rollers are rotatably secured, with their axes of rotation extending perpendicularly to the surface of one of the sleeves, to the blocks which are retractable by means of a power cylinder connected with the roller block housing at each end of the arm;

a nut attached to each of the arms is in threaded engagement with a threaded rod, and the roller-type contact members are moved along the axis of the upper or lower associated roll by rotating the threaded rod in threaded engagement with the arm, with power being transmitted from a motor equipped with a reduction gear through one or more gear boxes and a toothed wheel, and, if necessary, through a connecting rod.

A more detailed description of the present invention will be given below with reference to the accompanying drawings.

FIG. 1(*b*) is a side view of the mill of FIG. 1(*a*);

FIG. 2(*b*) is a side view of the mill of FIG. 2(*a*);

FIG. 4(*b*) is a sectional view take along the line A—A of FIG. 4(*a*);

Figure 5A:
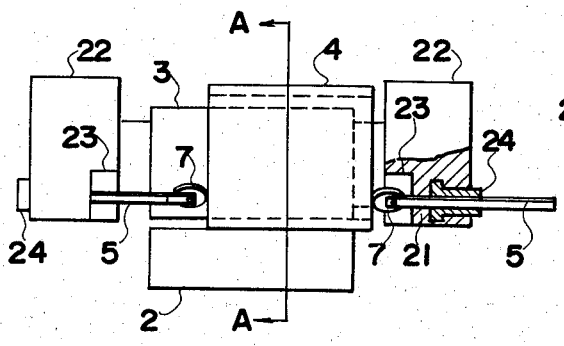
Figure 5B:
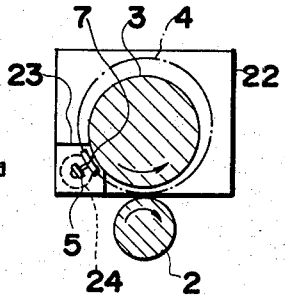
Figure 6A:
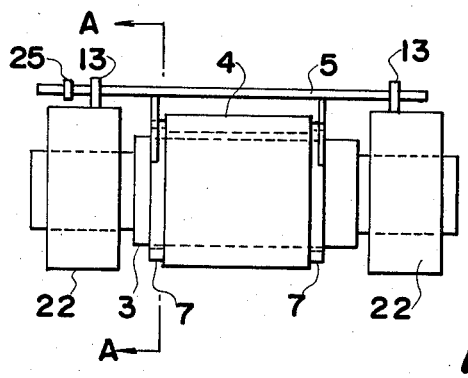
Figure 6B:
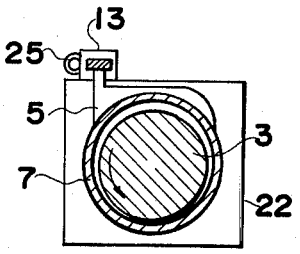

FIGS. 5(*a*) and (*b*) are front and sectional views, respectively, of a one-way four high mill embodying the invention; and FIGS. 6(*a*), (*b*), and 7(*a*), (*b*) are front and sectional views of still other embodiments of the invention.

For the purposes of the invention, the expression "to restrain or restrict the axial shifting of the sleeve" means to restrain or restrict the sleeve lest the sleeve move any substantial distance axially in either direction away from the desired position. This can be accomplished, for example, by guiding the sleeve by contact members at both axial ends of the sleeve or by a contact member or contact members fitting in an annular groove at the middle on the outer surface of the sleeve.

The term "restricting point" or the "point where a restricting force is applied" is used to indicate a point where each contact member, in contact with a sleeve, transmits a restricting force to the latter, in particular concerning the angular position along the circumference of any cross section of the sleeve.

By "loosely positioned" or ". . . carried" is meant a state in which a sleeve is positioned on or carried by the associated roll so that during a rolling operation it can rotate together with the roll at the same peripheral velocity, without axial or circumferential restriction but merely with the force of friction at the contacting portions between the outer surface of the roll barrel and the inner surface of the sleeve. In that state there is provided between the two surfaces a visibly discernible clearance of more than one millimeter (practically, in the range of 3–25 mm).

The term "loading point" denotes the circumferential position of the contact point or narrow area which is defined when a sleeve loosely positioned on a roll receives a force resulting from the rolling pressure and directed toward the sleeve center, from another roll or the workpiece in contact with the sleeve at one side of its outer surface, and where the force so received is transmitted from the inner surface of the sleeve to the outer surface of the sleeved roll. Because this area is a linear region substantially parallel to the axis of the roll, its position is specified in terms of its angular location along the circumference of the sleeve.

Now, to clarify the features and advantages of the invention, the movement of a sleeve loosely positioned on a roll will be explained in relation to the rotational direction of the roll, the point of loading on the roll, and the point where a restricting force is applied from a contact member to the sleeve.

Figure 2A:
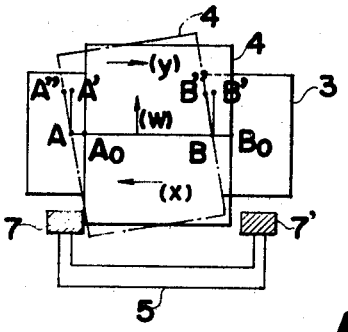
FIG. 2(*a*) is a front view of essential parts of a four high mill incorporating the present invention, illustrating the movement of each sleeve during a rolling operation.
Figure 2B:
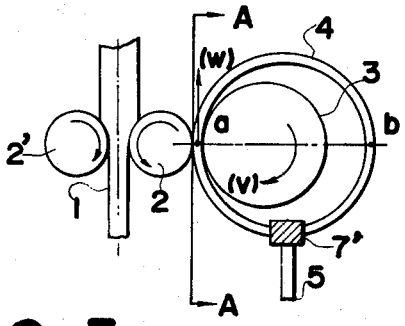

FIGS. 2(*a*) and (*b*) show essential parts of a four high mill to which the present invention is applied, with a sleeve loosely positioned on each back-up roll.

In the arrangement shown, one function of a pair of contact members 7 and 7' is to restrict the spontaneous axial shifting of the associated sleeve 4 and keep the latter at a certain desired position on the barrel of the back-up roll as viewed in the axial direction.

Another function of the contact members 7 and 7' is to shift the sleeve axially of the roll according to the width of the flat metal piece to be rolled.

The sleeve is restricted in its axial movement or the position thereof is shifted by being guided at both ends by the contact members. In either case, the barrel length of the sleeve need not be exactly equal to the distance between the contact members 7 and 7'. With an ordinary hot or cold strip mill capable of rolling metal into a 7 ft.-wide strip, for example, the distance between the contact members 7 and 7' may be designed to be greater than the barrel length of the sleeve with the tolerance of about 3 mm.

The manner in which the present invention is practiced with the sleeves and means for restricting the axial movement and for shifting the position of the individual sleeves with the foregoing construction, will now be described. On the segment AoBo in FIG. 2(*a*) or at the point a in FIG. 2(*b*), which is called the "loading point," the sleeve 4 is subjected to a compressive load from the associated working roll 2 and is held in contact with the working roll on its outer circumferential surface and with the back-up roll on its inner surface.

During the rolling operation the back-up roll 3 continues to rotate in the direction of the arrow (v) in FIG. 2(*b*). Accordingly, the material of the sleeve 4 at the loading point (a) runs in the direction of the arrow (w) in FIG. 2(*a*) or 2(*b*).

For the contact members 7 and 7' it is imperative that, when the back-up roll 3 is rotating in the direction of the arrow (v) as in FIG. 2(*b*), the members should be so installed in the sleeve-restricting force is applied from the contact members 7 and 7' to the sleeve 4 somewhere on the second semicircular portion of the sleeve 4, starting from the point b halfway around the sleeve from the point a to the point a, moving in the rational direction.

Now if it is assumed that, for some reason, for example, due to nonsymmetric axial distribution of rolling load or to some slight abrasion of the rolls, the sleeve 4 has moved spontaneously in the direction of the arrow (x) in FIG. 2(*a*) to the point where the advancing end is in contact with the contact member 7. Then, as indicated by alternate long and short dashed lines, the axis of the sleeve 4 will be slightly inclined relative to the axis of the back-up roll 3, and the sleeve will run temporarily in the tilted posture.

With the sleeve 4 thus tilted, the segment AoBo in FIG. 2(*a*) is shifted to the position of the segment AB.

Since the sleeve portion at the loading point represented by the segment AB runs in the direction of the arrow (w), the segment AB will move to A'B' after rotating for a short period of time.

If the tilted state of the sleeve, represented by alternate long and short dashed lines in FIG. 2(*a*), is to be a steady state, the segment AB will have to move to the position A"B" after said period of time; but actually it will move to the position of segment A'B'. In other words, the tilted position indicated by the alternate long and short dashed lines in FIG. 2(*a*) cannot be a steady state, and after a brief time span the sleeve end points A" and B" will shift in the direction of the arrow (y) to the points A' and B', respectively. The shifting will naturally reduce the inclination of the sleeve 4 and will lessen the pressure being exerted on the contact member 7. As long as the sleeve is held in this way within the given region, the automatic inclination-controlling action will keep the sleeve only slightly inclined, with practically no force being exerted on the contact members. On the other hand, when the contact members 7 and 7' are shifted in the axial direction of the back-up roll with a corresponding axial sleeve movement, the sleeve 4 will be kept in the tilted posture as indicated by the broken lines in FIG. 2(*a*).

The manner in which the sleeve is shifted in this case will now be explained with reference to FIG. 2(*a*), on the assumption that the arm 5 and therefore the contact members 7 and 7' supported thereby are being moved in the direction of the arrow (y) in order to shift the sleeve in the same direction.

In this case the sleeve 4 receives a force from the contact member 7 and is tilted to the posture represented by the alternate long and short dashed lines in FIG. 2(*a*).

As the rolls rotate with the sleeve in that posture, the segment AB will move after a short time to the position of segment A'B' as already explained. This action will reduce the inclination of the sleeve when the arm 5 is stationary. When the sleeve is being shifted, however, the contact member 7 is moving in the direction of the arrow (y) and, if its velocity is such that the contact member 7 travels a distance equal to the length of the segment A"A' while the point A proceeds to A', the inclination at the end of the sleeve 4 will be kept parallel to the corresponding broken line in FIG. 2(*a*). During such forced shifting, the sleeve 4 will move while remaining tilted at a substantially constant angle. The force required at this time to be supplied by the contact member 7 is used to maintain the sleeve tilted at that constant angle.

The inclination of the sleeve 4 may be represented by the ratio of the length of the segment A"A' to that of the segment AA'. As explained above, this ratio equals the ratio of the velocity $V_S$ of axial shifting of the sleeve 4 to the circumferential velocity $V_R$ of the back-up roll, i.e., $V_S/V_R$. Practically, the sleeve shifting velocity $V_S$ required is very small while the tangential speed $V_R$ is quite fast, and usually a $V_S/V_R$ ratio approximately between 0.001 and 0.01 will suffice for practical purposes. Thus, even when the sleeve 4 is forcedly shifted in the axial direction, the gradient of inclination of sleeve 4 is quite limited, within from 0.001 to 0.01. Because the geometric relation between the sleeve 4 and the back-up roll 3 requires the axes of both to be parallel in the natural state, in order that the sleeve be kept tilted at the given angle, the sleeve 4 and the roll 3 should both undergo elastic deformation to a certain degree in the vicinity of the loading point a, which suggests that the force to be exerted on the contact member 7 is approximately proportional to the inclination of the sleeve 4. However, the inclination is actually so limited as described above that an extremely small force (according to experiments, for example, at most 0.005× rolling force) is enough for shifting the sleeve 4 in the axial direction.

Figure 3:
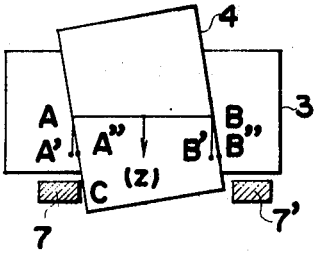
FIG. 3 is a view similar to FIG. 2(*a*) but showing the sleeve running in the reverse direction.

For the sake of comparison, it is assumed that, contrary to the arrangement of the embodiment shown in FIGS. 2(*a*) and (*b*), the contact members 7 and 7' for guiding the sleeve 4 at both ends are located somewhere along the first-half semi-circular portion of the sleeve 4 as viewed in the rotational direction of a complete turn starting at the loading point a. In that case the relation between the positions of the contact members and the direction in which the sleeve turns is the reverse of that according to the present invention. As illustrated in FIG. 3, the direction of movement of the segment AB at the loading point may be regarded as that indicated by the arrow (z), which is opposite to the direction of the arrow (w) in FIG. 2(*a*). Then, when the sleeve 4 is forced against the contact member 7 and is rotating with its axis inclined relative to the axis of the back-up roll as indicated in FIG. 3, the segment AB will move after a short period of time to the position of segment A'B'. The inclination of the sleeve end facing the contact member 7, at the moment the points A and B have just moved to the points A' and B' respectively, is represented by a straight line CA' that passes through the point C of contact between the sleeve 4 and the contact member 7 and also through the point A' in FIG. 3. This inclination is greater than that of the sleeve when the inclination of the sleeve 4 shown in FIG. 3 is assumed to be a steady state, i.e., that the straight line CA". Thus, the inclination of each sleeve during the course of rolling will become greater until unavoidable slip in the axial direction takes place at the loading point, and the force exerted on the contact member 7 will become greater, with consequently accelerated abrasion and heat development at each contact member, especially during a high speed rolling operation. Thus, if the contact members are disposed at points opposite to those in accordance with the invention as exemplified by this comparative arrangement, the contact member will be subjected to a very great force (for example, 1/10× rolling force according to experiments) even when the sleeve is held in a constant position.

While the sleeve motion has thus far been described in connection with FIGS. 2(*a*) and (*b*) that illustrate an embodiment of the invention and with FIG. 3 that shows the reverse or conventional arrangement for comparison purposes, the same applies to the arrangements in which the sleeve is urged against the other contact member 7' instead of the member 7. From the symmetry of arrangement in FIG. 2(*b*), it will also be readily understood by those skilled in the art that the same is true with the other back-up roll [i.e., the roll not shown but which is in contact with the working roll 2' in FIG. 2(*b*)], considering the rotational directions of the sleeves and the positional relationship between the contact member locations and the loading points.

As will be obvious from the foregoing description, the requirements to be met for the practice of the present invention are that (1) each sleeve should be loosely positioned on the associated back-up roll, so that it can revolve and/or shift axially relative to the roll, and (2) the sleeved roll should sustain a load that is acting radially from one side of the barrel toward the center of the sleeve so that the outer surface of the roll barrel in contact with the inner surface of the sleeve, the contact zone being substantially parallel to the roll axis and at the same angular position as the loading point. An essential feature of the present invention is that, with the satisfaction of such requirements, the restricting point at which the force to cause the axial shifting or restrict the axial shifting of the sleeve is applied lies somewhere on second-half semicircular portion of the sleeve as viewed in the rotational direction of a complete turn from the loading point a to the opposite point b and thence back to the point a. Therefore, the types of rolling mills to which the teaching of the invention is applicable are, for example, two high mills the rolls of which loosely carry sleeves with which to roll the workpiece, and multiple rolling mills the final rolls of which, such as the upper and/or lower back-up rolls of four high mills, are provided with loose sleeves.

In all of the embodiments of the invention to be described below, the means of restricting the axial shifting of the sleeve is an arrangement in which the sleeve is guided at both axial ends of the sleeve by a pair of contact members. However, this is not a limitation to the invention; other means are also employable, including a contactor having rollers, hydrostatic lubrication or other suitable antifrictional means, and fitted in an annular groove formed on the outer circumferential surface in the middle of the sleeve so as to restrict the axial shifting of the sleeve.

As exemplified by the following embodiments, the present invention minimizes the forces applicable to the contact members and thereby permits marked reduction in the abrasion and frictional heat developed in those parts especially during a high speed rolling operation.

EMBODIMENT 1

Figure 7A:
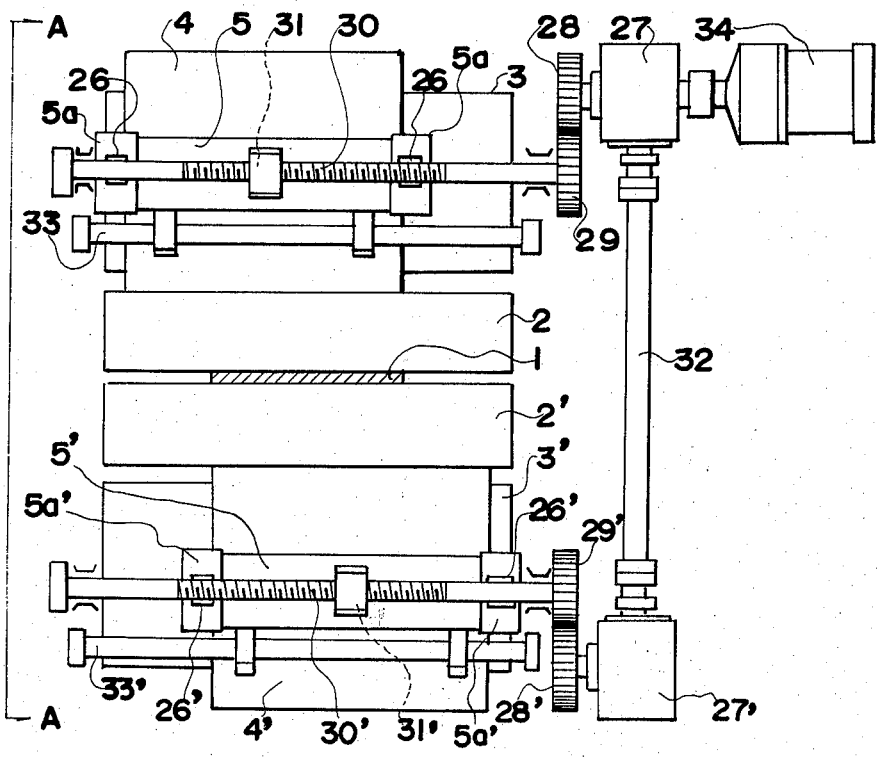
Figure 7B:
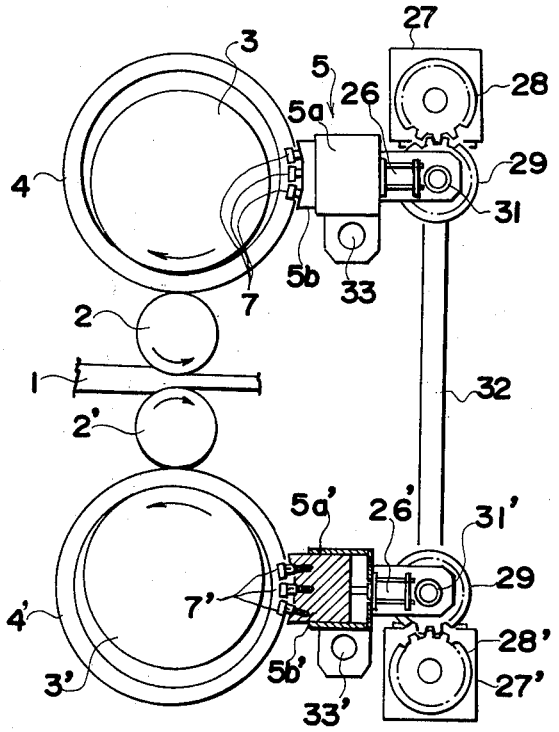

FIGS. 7(*a*) and (*b*) illustrate an embodiment of the invention as applied to a four high mill the upper and lower back-up rolls 3 and 3' of which loosely carry sleeves 4 and 4', respectively, with units for shifting the sleeves axially and associated contact members.

This embodiment uses contact members in the form of rollers. The rollers 7 and 7', shown in a set, for example, are rotatably secured, with their axes of rotation extending perpendicularly to the surface of one of the sleeves 4 and 4', to a block **5*b* which in turn is retractable by means of a power cylinder 26 into a roller block housing 5*a* at each end of an arm 5**. Each block thus carries a plurality of (in the embodiment shown, three) rollers, so that the forces required for the shifting or restriction of the sleeves are distributed among a number of rollers and the durability of the individual rollers can be increased.

As described above, the rollers are supported at both ends of the arms to shift the sleeves with the movement of the arms. Each of the arms is moved by the rotation of a threaded rod 30 and 30' threadedly engaged with a nut 31 and 31' attached to the corresponding arm 5 or 5'.

When shifting the sleeve 4 on the upper back-up roll 3, for example, power from a motor 34 equipped with a reduction gear is transmitted to a gear box 27, then to the gear wheels 28 and 29, the threaded rod 30 fixed at one end to the gear wheel 29, and the nut 31 on the arm 5, in the order mentioned, to drive the arm 5.

At the same time, in order to shift the sleeve 4' loosely positioned on the lower back-up roll 3', the power from the motor 34 and the reduction gear is transmitted to the arm 5' through the gear box 27, connecting rod 32, gear box 27', gear wheels 28' and 29', threaded rod 30' fixed to one end of the gear wheel 29', and the nut 31' fast on the arm 5'.

In order to move the upper and lower arms 5 and 5', simultaneously over the same distances in directions opposite to each other, the gear boxes 27 and 27' are designed to cause rotation of the upper and lower threaded rods in opposite directions. The position of the arm 5, for example, is sensed by counting the rotations of the threaded rod 30 by means of a selsyn (not shown) or the like. Guide rods 33 and 33' are provided to keep the arms from turning around the respective threaded rods 30 and 30'. When it is necessary to extract either of the sleeved back-up rolls from the mill housing to exchange the same, the corresponding block **5*b* or 5*b'* is retracted by the cylinder 26 or 26'**.

Figure 1A:
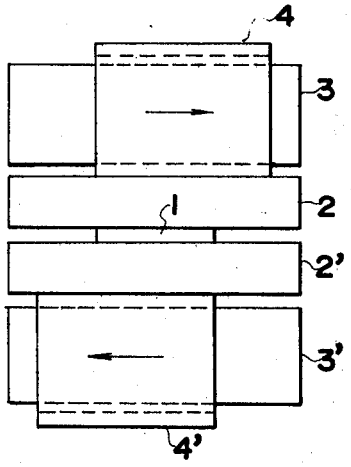
FIG. 1(*a*) is a front view of essential parts of a four high mill having loosely sleeved back-up rolls, with the sleeves being shiftable in the axial direction of the rolls to suit the width of the workpiece to be rolled.
Figure 1B:
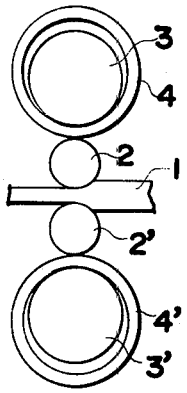

With the construction above described, the rolling mill embodying the invention is capable of shifting the sleeves 4 and 4' in the axial directions. For flat metal pieces in widely varying widths the sleeves 4 and 4' can be staggered as shown in FIG. 1(*a*) to align their one ends substantially with either edge of the workpiece 1 being rolled, so as to minimize the deflections of the working rolls 2 and 2'. In addition, when the roll deflections are to be corrected by a positive roll bender to control the crown of the rolled piece within a desired range, the effect of the benders as such will be markedly improved in the four high mill incorporating the invention as compared with conventional four high mills.

EMBODIMENT 2

Figure 4A:
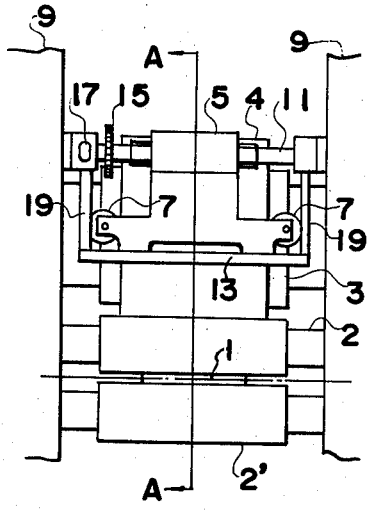
FIG. 4(*a*) is a front view of a reversing four high mill embodying the invention.
Figure 4B:
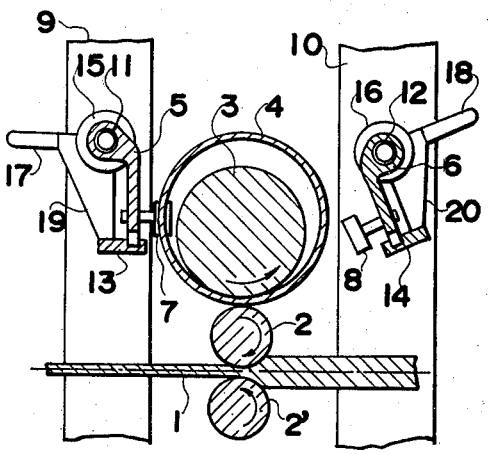

Here the invention is embodied in a reversing four high mill as illustrated in FIGS. 4(*a*) and (*b*). Since the rolling direction is changeable, each backing-up roll 3 loosely carrying a sleeve 4 is designed to rotate in either direction. For this reason two separate units for supporting and guiding the sleeve 4 between them are installed on both sides of the mill as viewed in the direction in which the metal passes. This means that the sleeve 4 can be guided by either pair of contact members 7 or 8 in the form of rollers. The contact members 7 and 8 are respectively secured to arms 5 and 6, which in turn are pivotally supported at the upper ends and which have internally threaded holes which are engaged with threaded rolls 11 and 12. The threaded rods 11 and 12 carry gear wheels 15 and 16, respectively, which are driven by prime motor means (not shown) to rotate the threaded rods. The arms 5 and 6 are kept from turning around the threaded rods by guides 13 and 14. Because bearings at both ends of the threaded rods 11 and 12 are fixedly mounted on the housings 9 and 10 of the rolling mill, rotation of the threaded rods enables the arms 5 and 6 and therefore the contact members 7 and 8 to move parallel to the axis of the back-up roll. The guides 13 and 14 are attached to brackets 19 and 20 which are turnable through a predetermined angle around the axes of the threaded rods 11 and 12. The brackets 18 and 20 have handles 17 and 18 which, when shifted, cause the guides 13 and 14 and hence the arms 5 and 6 to turn through a predetermined angle around the axes of the threaded rods 11 and 12, as indicated in FIG. 4(*b*). When rolling with the arrangement described is carried out in the direction indicated in FIG. 4(*b*), the sleeve 4 is guided by the contact members 7, and when the direction is reversed the sleeve 4 is guided by the contact members 8. For a change or replacement of a roll the contact members 7 and 8 can all be retracted from the sleeve guiding positions.

FIG. 4(*b*) shows only one of the contact members 7 guiding the sleeve 4, while the corresponding contact members 8 are in the retracted position. However, because the contact members 7 restrict the sleeve 4 to a negligible inclination of its axis, it is not objectionable to perform the rolling operation with the contact members 8 also guiding the sleeve, provided both contact members 7 and 8 are accurately set in proper relative positions as viewed in the axial location. Thus, the rolling is possible with the sleeve guided by the both sets of contact members 7 and 8.

It is to be noted in this connection that, as will be obvious from the principle of the invention already explained with reference to FIGS. 2 and 3, a contact member is subjected to a rather excessive force only when the sleeve tilts excessively (as when the contactor is located opposite to the side taught by this invention). This means that tilting the sleeve to a smaller degree will give a good result. This end is attained by providing the contact members either (1) only on the side of the sleeve according to the invention or (2) on the side according to the invention and also on the opposite side.

The arrangement (1) takes advantage of the phenomenon that, even in the absence of contactors on the other side, the inclination of the sleeve will automatically decrease to a small value. In either case the provision of the contactors on the side designated by the invention is imperative, since it is manifest that the restricting forces to be exerted by the contactors located on the side according to the invention will play a decisive role in confining the sleeve inclination within a narrow range. When the contact members are to be used on both sides of each sleeve, i.e., on the side according to the invention and the opposite side, the members must be accurately positioned to allow for only a limited sleeve inclination. Also, when shifting the sleeve axially, a cumbersome procedure will become necessary, including staggering the relative position of the arms on both sides in order to give the sleeve a necessary inclination for the shifting. When workpieces of the same size and shape are each to be given a number of passes through a reversing mill, there is no necessity of shifting the sleeve positions during the process of rolling. Therefore, despite the aforementioned inconveniences, it is possible to carry on rolling with the sleeves supported and guided by the contact members on both sides, so as to save the time and labor of shifting the handles 17, 18 each time the rolling direction is changed. The sleeves may be shifted between passes or whenever the operation is to be switched over to rolling of workpieces of a different size or shape when no rolling pressure is needed.

EMBODIMENT 3

This is an embodiment of the invention applied to a one-way four high mill as shown in FIGS. 5(*a*) and (*b*). Here contact members 7 are designed to guide each sleeve 4, as indicated in FIG. 5(*b*), in locations along the second-half semicircular portion of the sleeve 4, as viewed in the direction of a complete turn ending at the loading point, and close to the latter point. The contact members 7 consist of rollers, which are supported by separate rods 5 threadedly engaged with internally threaded pieces 24. Each piece 24 is rotatably fitted in a roll chock 22 at each end of the back-up roll 3. On the other hand, each rod 5 has a guide groove therein, in which a guide 21 formed in the roll chock 22 fits to keep the rod from rotating. As each of the internally threaded pieces 24 is rotatably driven from the outside, the support rod 5 is moved in the axial direction of the back-up roll 3. A recess 23 formed in each roll chock 22 for the roll 3 serves as a space for accommodating the contact member 7, thus extending the axial shifting range of the sleeve 4 accordingly.

EMBODIMENT 4

This is another embodiment of the invention in which each final back-up roll 3 has a sleeve 4 loosely positioned on the barrel thereof, as shown in FIGS. 6(*a*) and (*b*). Contact members 7 are in the form of rings having substantially the same diameter as the sleeve 4. They have a multiplicity of tiny orifices on one side through which lubricating oil for rolling use is forced out to form an oil film between that side of each member 7 and the mating end of the sleeve 4, thus avoiding direct contact and lessening the friction. An arm 5, to which the contact members 7 are attached in common, extends at both ends through guide eyes 13 fixed to the chocks 22 of the back-up roll 3 and is movable only in the axial direction of the back-up roll 3. The arm 5 is provided with a rack in mesh with a worm 25 fixed to one of the back-up roll chocks 22, and the arm 5 can be moved in the axial direction of the roll by rotating the worm 25 by a drive means not shown. Where each contact member 7 is designed to exert a restrictive force on the entire circumferential surface of the sleeve 4, substantially the same effect is achieved as with the roller-type contactors 7 and 8 of the embodiment shown in FIGS. 4(*a*) and (*b*), coacting to support and guide each end of the sleeve at the same time. In the axial shifting of the sleeve 4, in the embodiment of FIGS. 6(*a*) and (*b*), essentially only the restricting force applied on the second-half semi-circular portion of the sleeve as viewed in the direction of its complete turn up to the loading point is effective.

Especially when the invention is similarly embodied in a one-way rolling mill, each sleeve can be axially shifted, even when it is under rolling pressure, in the following way. The arm 5 supporting ring-shaped contactors 7 is built or mounted in position as illustrated in FIGS. 6(*a*) and (*b*). Then, when either contact member 7 receives a force, the arm 5 will undergo elastic deformation with the result that the first half of the semicircular peripheral end in the direction of a complete turn of the sleeve 4 ending at the loading point will deflect considerably as compared with the second-half. Consequently, only the sleeve-restricting force on the side defined in accordance with the invention will act effectively to tilt the sleeve 4, making it possible to shift the position of the sleeve 4 with a small force.

We claim:

1. In a rolling mill including at least one roll on which a sleeve is loosely positioned in such a way that the sleeve is revolvable and axially shiftable with respect to the outer circumferential surface of the barrel of the associated roll, said sleeved roll being subjected to a rolling load, directed to the sleeve center from one side of said sleeve on the barrel, the outer circumferential surface of said roll barrel being in contact with the inner surface of said sleeve along a narrow area substantially parallel to the roll axis, the improvement comprising at least one unit for supporting and guiding said sleeve, with a restraining or a restricting point, at which a force for axially shifting or for restraining or restricting the spontaneous axial shifting of said sleeve is applied thereto, and being located somewhere along the second half semicircular portion of said sleeve as viewed in the rotational direction of a complete turn of said sleeve ending at the loading point where said rolling load is received.

2. A rolling mill according to claim 1, wherein there are two said units for supporting and guiding said sleeve and said units are installed on opposite ends of said sleeve as viewed in the rolling direction for alternate use depending on the direction of rotation of said roll.

3. A rolling mill according to claim 1 or 2, wherein said sleeve supporting and guiding unit has contact members, each in the form of at least one roller.

4. A rolling mill according to claim 1, wherein said sleeve-supporting-and-guiding unit has contact members, each in the form of a ring having substantially the same diameter as said sleeve.

5. A rolling mill according to claim 3, wherein each said contact member is in the form of a plurality of rollers.

6. A rolling mill according to claim 1, wherein said unit comprises an arm extending along said sleeve, blocks at each end of said arm, and roller-type contact members secured to said blocks and engaged with said sleeve for supporting and guiding said sleeve, and means for moving said contact members parallel to the axis of the associated roll having a threaded rod threadedly engaged with said arm and motor means driving said threaded rod and having a motor, a reduction gear driven by said motor, a gear box driven from said reduction gear, and a gear wheel on said threaded rod and driven by said gear box.

7. A rolling mill according to claim 1 wherein said mill is a four high rolling mill having upper and lower back-up rolls on which sleeves are loosely positioned respectively, and the unit for each sleeve comprises an arm extending along said sleeve, a housing at each end of said arm, blocks slidably mounted in said housing for sliding movement in and out of said housing, a plurality of roller-type contact members secured to said blocks with the axes of rotation extending perpendicularly to the surface of the sleeve, a power cylinder connected to each block for moving it in and out of the housing, and further comprising a nut attached to said arm, a threaded rod threadedly engaged with said nut, and motor means for driving said threaded rod and having a motor, a reduction gear driven by said motor, a gear box driven from said reduction gear, and a gear wheel on said threaded rod and driven by said gear box.

* * * * *